US009750981B2

(12) United States Patent
Davis

(10) Patent No.: US 9,750,981 B2
(45) Date of Patent: Sep. 5, 2017

(54) APPARATUS AND METHOD FOR AN IMPROVED HAND FIN

(71) Applicant: Robert Gordon Davis, Encinitas, CA (US)

(72) Inventor: Robert Gordon Davis, Encinitas, CA (US)

( * ) Notice: Subject to any disclaimer, the term of this patent is extended or adjusted under 35 U.S.C. 154(b) by 0 days.

(21) Appl. No.: 14/971,130

(22) Filed: Dec. 16, 2015

(65) Prior Publication Data

US 2017/0173397 A1 Jun. 22, 2017

(51) Int. Cl.
*A63B 31/04* (2006.01)
*A63B 31/08* (2006.01)
*A63B 31/10* (2006.01)

(52) U.S. Cl.
CPC ..... *A63B 31/04* (2013.01); *A63B 31/08* (2013.01); *A63B 31/10* (2013.01)

(58) Field of Classification Search
CPC ..... A63B 31/00; A63B 31/04; A63B 31/08
USPC ..... 441/57, 58
See application file for complete search history.

(56) References Cited

U.S. PATENT DOCUMENTS 2,159,972 A * 5/1939 Larson ..... A63B 31/08 441/58
2,211,536 A * 8/1940 Clayton, Jr. ..... A63B 31/08 441/57
2,389,196 A * 11/1945 Harmon ..... A63B 31/08 441/58
3,122,760 A * 3/1964 Glass, Jr. ..... A63B 31/04 441/57
4,437,842 A 3/1984 Connor
4,932,911 A * 6/1990 Albrecht ..... A63B 31/10 441/58
5,167,551 A 12/1992 Davis
6,544,089 B2 4/2003 Zapatero Denegri
D585,104 S 1/2009 McCarthy
8,105,125 B2 1/2012 Sick
8,496,506 B2 7/2013 Wenzel
8,864,539 B1 10/2014 Watts
2013/0309922 A1 5/2013 Smith
2014/0162512 A1 6/2014 Hanrahan

OTHER PUBLICATIONS

Soul Handplanes, et al., http://goo.gl/yHOvX7.

* cited by examiner

*Primary Examiner* — Lars A Olson

(57) ABSTRACT

In the sports of bodysurfing and swimming, hand fins are worn for increased speed, stability, and maneuverability. Each hand fin has an internal compartment for the hand fin to be reliably held and controlled by the user. An upwardly angled, rounded peripheral lip provides lift and prevents pearling when water is flowing at the hand fin from any direction. A concave bottom and rocker creates lift and maneuverability.

19 Claims, 6 Drawing Sheets

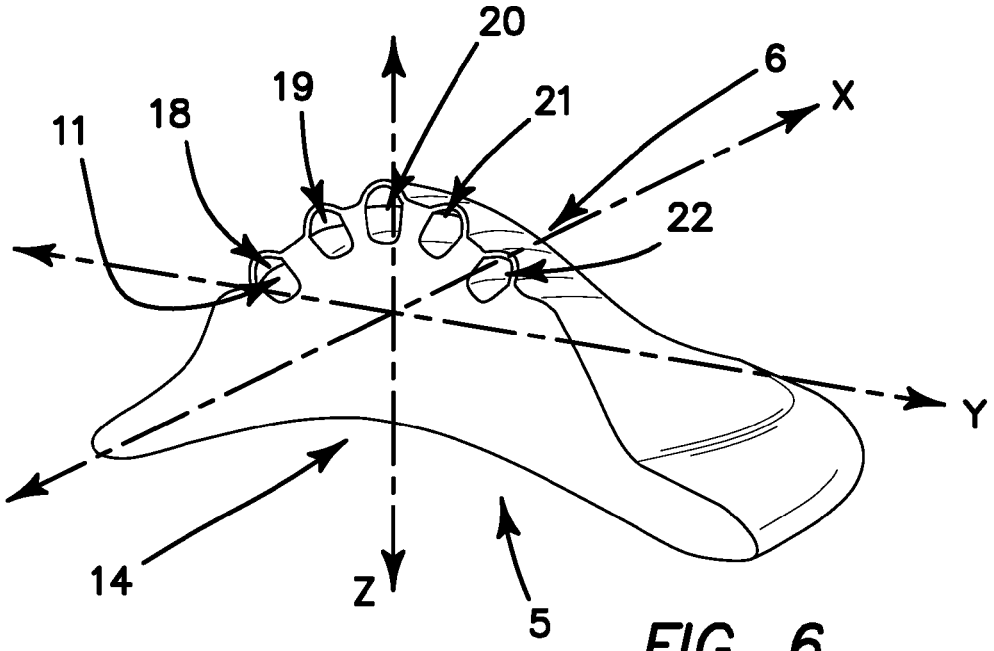
FIG. 6
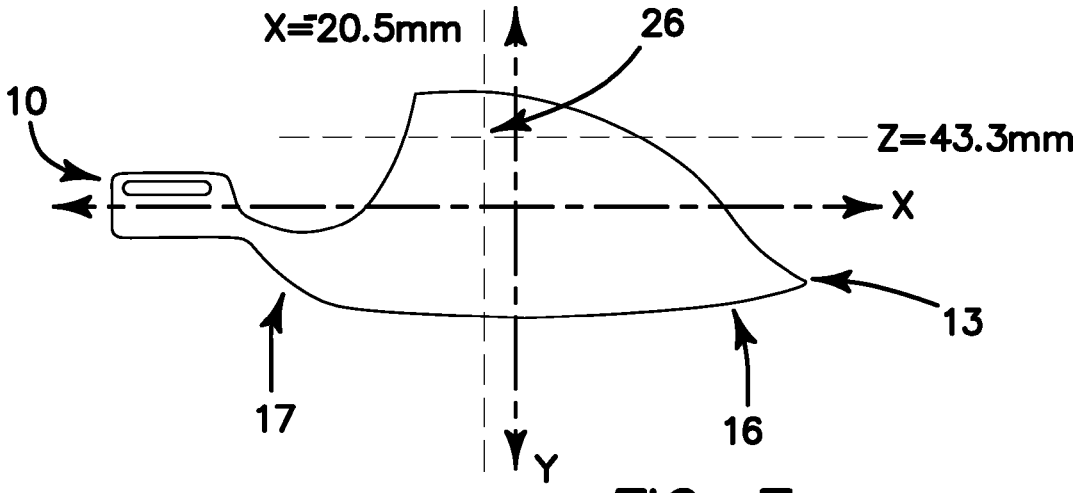
FIG. 7
FIG. 8
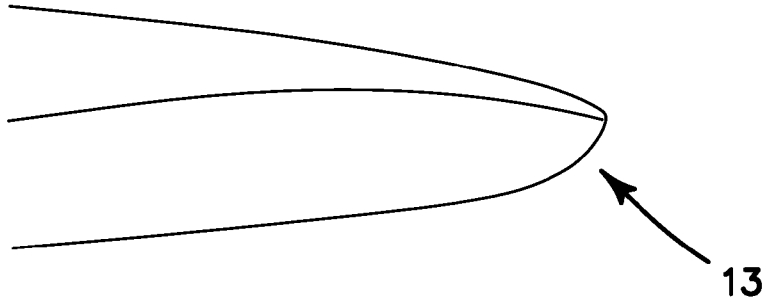

APPARATUS AND METHOD FOR AN IMPROVED HAND FIN

BACKGROUND

1. Field of the Invention

The present invention relates to the field of devices worn on the hand or hands of the user for the sports of bodysurfing and swimming, namely CPC A63B31/04.

2. Description of Background

The sport of bodysurfing has been popular for many years. Bodysurfing involves riding a wave with one's own body. To catch a wave, the body surfer swims vigorously with the wave to the point where the momentum of the wave propels the bodysurfer along with the wave. Once the bodysurfer "catches" the wave, he usually places one or two hands in front of his body, raises his head and chest above the water, and rides the wave.

The prior art has proposed various hand fins and other supports to increase buoyancy or speed through the water. The problem with the prior art is that it focuses on the riding of the wave and not the swimming portion of bodysurfing. Many of the prior art devices need to be dragged along by the user while swimming and then put on the hands when the user is about to ride the wave. This creates drag while swimming. It is also inconvenient to attach the fin when the user wants to catch the wave and remove the fin when he wants to swim back out to be in the position to catch another one. Another issue is that because the fins are not meant to be used for swimming, the user must swim with only one arm while trying to catch the wave because the other arm is unusable for swimming because it is being used to hold the fin.

Additionally, the fins in the prior art are not secured to the hand and therefore the user can easily lose control of the fin. In the prior art, the fins either have a large compartment into which the hand is inserted or a strap which connects the hand to the fin. In either case, water flows between the fin and the hand, causing drag, which decreases speed. Additionally, the lack of a secure gripping mechanism allows the device to be easily pulled from the hand.

Much of the prior art is based on a surfboard like design. The problems with these designs are numerous. Fins made out of hard material are dangerous if they come into contract with the user or others. Keels on the bottom on the fin help with control, however, the strength needed to maneuver with a center keel is enormous and too much for the average bodysurfer, causing the bodysurfer to loose control rather than have more control. The keel is dangerous in that with the slightest turn of the hand, the water pressure pushes at an angle to the keel and causes the fin and arm to be ripped backwards, which may lead to injury or at least the termination of the ride.

Due to the issues mentioned above, current bodysurfing devices are riddled with problems. Users cannot enjoy their bodysurfing experience when their hand fins are ripped off by the water and when those loose devices strike the user or others. This is especially true when those devices are made from hard material. Furthermore, it is not desirable to have a device that must be dragged along side the user while the user is swimming in the water instead of aiding the user in the swimming. Additionally, the lack of steering combined with the ability to control the device is undesirable. Finally, it would be desirable to increase the buoyancy and speed of the user, which these prior art devices do not do.

BRIEF SUMMARY

The illustrated embodiments of the current invention provides a solution to each of the limitations of the prior art by having a hand fin for use on a hand of a user in the water comprising a buoyant blade having a front and rear, bottom and top surfaces, and left and right edges. The bottom surface of the hand fin is concave between the front and rear and concave between the left and right edges. The concavity creates lift as the water moves along the concave bottom, pushing up against the bottom of the fin and then down and away from the fin. The concavity causes the left and right edges to cut into the wave, acting like a keel, and gives the user control. The concavity between the front and the rear do not cause the front and rear edges to cut into the wave because the front of the blade is tilted up and the rear of the blade is tilted up, forming a curvature on the bottom of the hand fin called a "rocker." The rocker gives the hand fin more control while maintaining speed. The rocker causes the edges of the hand fin to come in contact with the water about a third of the way back from the front, creating lift and allowing the hand to relax without the hand fin "pearling." Pearling can occur when water pushes against the top surface at a wrong angle, pushing the hand fin down and causing the hand fin and user to be pulled downward, into the wave. The blade includes a peripheral lip encircling the blade. In the preferred embodiment, the peripheral lip is rounded and angled upward. The rounded lip assists in steering the fin from left to right. The upward angle allows water to be directed under the concave bottom surface, thus providing lift even during steering. It also allows water to flow under the concave bottom from any direction, thus the user can rotate his hand in either direction with little resistance. Therefore, the user can try many different styles of bodysurfing with out worrying that the water will grab an edge, begin to flow over the top surface of the fin and then have the hand fin be pulled back with the wave as the rest of the user's body is still moving forward.

The top surface slopes downwardly from the rear to the front. The streamlined nature of the bottom and top makes it possible for the user to ride the wave with the hand fin skimming across the water as well as with the hand fin submerged underwater. The top surface is design so that when water hits it, the water pushes down on the hand fin. Therefore, when it is submerged underwater, the water's upward pressure on the bottom surface and downward pressure on the top surface stabilizes the hand fin. Additionally, the upward pressure is greater than the downward pressure. This helps avoid pearling and the user can easily bring the hand fin back to the surface of the water by angling the hand fin up to the surface.

The hand fin has an internal compartment defined in the blade between the top and bottom surfaces. The hand fin has an opening defined in the top surface toward the rear of the blade, where the hand of the user is inserted through the opening into the internal compartment. The blade includes a raised section extending into the internal compartment. The raised section has a shape conforming to a palm of the hand. The blade also has a plurality of finger compartments for the placement of each finger of the hand into a corresponding one of the plurality of finger compartments to create a gripping surface in which the hand can be placed in a cupped configuration. The each finger compartment have a has shape conforming to a finger of the hand. When the hand is inserted into the internal compartment, the hand is secured within the hand fin allowing the user to not only swim while wearing the hand fin, but increase the user's speed due to the increase in surface area of the hand fin compared to the user's hand. The hand fin securely hugs the hand and thus water is obstructed from entering the internal compartment. Additionally, the position of the hand when cupped creates pressure between the bottom on the fingers and the internal surface and also between the knuckles and the internal surface. Thus the hand fin is affirmatively prevented from being pulled away from the user's hand, which also decreases the risk of injury. In the preferred embodiment, the internal compartment has an internal wall that is textured for additional frictional engagement with the hand and thus increased prevention of having the hand fin pulled away.

In the preferred embodiment, the finger compartments are located forward from the center of gravity. This gives the user better leverage and control during swimming. It also prevents the hand fin from bouncing uncontrollably while being used to ride a wave.

Also in the preferred embodiment, the hand fin has an integral, ergonomically designed wrist strap connector that extends from the bottom surface for attachment of a leash. The leash allows the user to remove the hand fins as desired without the worry of loosing them. The wrist strap connector extends from the bottom surface of the hand fin and lies flat against the wrist. This encourages water to flow under the bottom surface when water is flowing from many directions, for example from the back of the fin to front. The hand fin can be used in any direction and water is obstructed from entering the internal compartment. Thus the hand fin is affirmatively prevented from being pulled away from the user's hand, which additionally decreases the risk of injury.

A preferred embodiment of the hand fin has an adjustable strap aligned with respect to the knuckles to hold hand in place, the adjustable strap being secured to the fin on each side of the hand.

Furthermore, the preferred embodiment is made from one piece of flexible material. The preferred material being a closed cell foam made from ethylene vinyl acetate. The flexible material helps prevent injury. The material is flexible and therefore the internal compartment can accommodate different size hands. The flexible nature of the material allows user to cup his hand more and thus increase the pressure between the hand and the internal surface, as described above. The material is also buoyant, does not absorb water, and is anti-bacterial.

Aside from the hand fins being a bodysurfing aid, the hand fins can also be used as an exercise aid to be used in water. The hand fin is ideal for training the hand to be in the appropriate configuration for swimming due to the ergonomically designed internal compartment. The hand fins can be used to strengthen the user's arm muscles due to the resistance created in the water.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE SEVERAL VIEWS OF THE DRAWINGS

FIG. 6 is a three quarter rear perspective view of a cross section through line 6-6 of FIG. 7.

FIG. 7 is a side elevational view of the hand fin.

FIG. 8 is a side elevational view in enlarged scale of the front lip of the hand fin.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION

Figure 1:
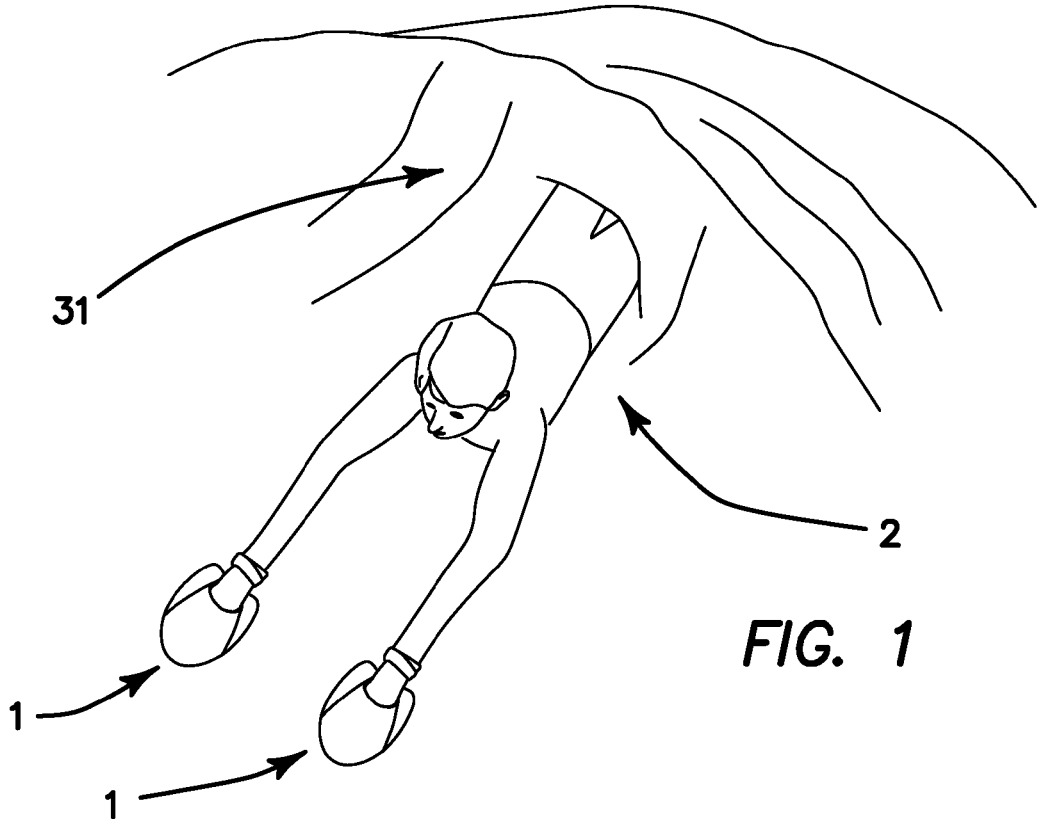
FIG. 1 is a front perspective view of a bodysurfer using a pair of hand fin according to this invention.

Referring now to the drawings, a pair of hand fins 1, 1' are depicted in FIG. 1 during use by a user 2 who is riding a wave 31. The user 2 is generally horizontal in the water with both arms forwardly stretched out in a relatively parallel position to one another. While traveling forwardly in the wave 31, the user's 2 arms push down on the hand fins 1, 1' resulting in head and chest being raised above the water. The hand fins 1, 1' can be used in many different arrangements. For example, arms can be place in a more perpendicular than parallel position to the body, thus lifting the torso more out of the water than described above. Or, both hands can be placed by the thighs, around the user's 2 center of gravity, with the hand fins pointed forwards or backwards. The user 2 can also spin his body around while riding the wave, by extending one hand and pushing down on the fin with that hand while the other hand is raised perpendicular to his body and is moved back down to the other side of his body. This creates a pinwheel effect with the arms with respect to the body, causing the body to spin in the water.

The hand fins 1, 1' have mirror symmetry to each other and are respectively worn on the user's left and right hand. For ease of illustration, only the right hand fin 1 is illustrated in the other figures.

Figure 2:
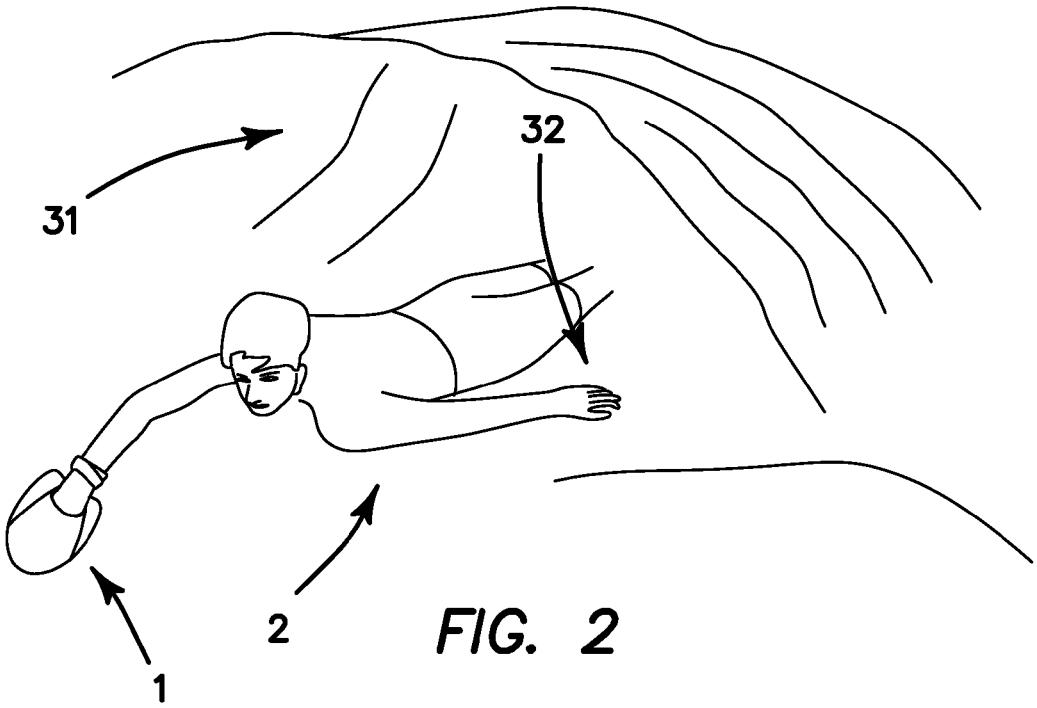
FIG. 2 is a front perspective view of a bodysurfer using one hand fin according to this invention.

As shown in FIG. 2, a hand fin 1 is depicted during use by a bodysurfer 10 who is riding a wave 31. The user 2 has one arm stretched forwardly out in front of him while the other arm 32 is place beside the body with the hand by the corresponding leg. Similar to FIG. 1, the user 2 can still raise his body above the water by pushing down on the hand fin 1, but in FIG. 2 the other arm 32 is placed against the body to reduce friction with the water and therefore create less drag. The user 2 could also wear a hand fin on the other arm 32 and cup the bottom of the hand fin against the leg to reduce friction or face the bottom of the hand fin away from the leg to increase control.

Figure 3:
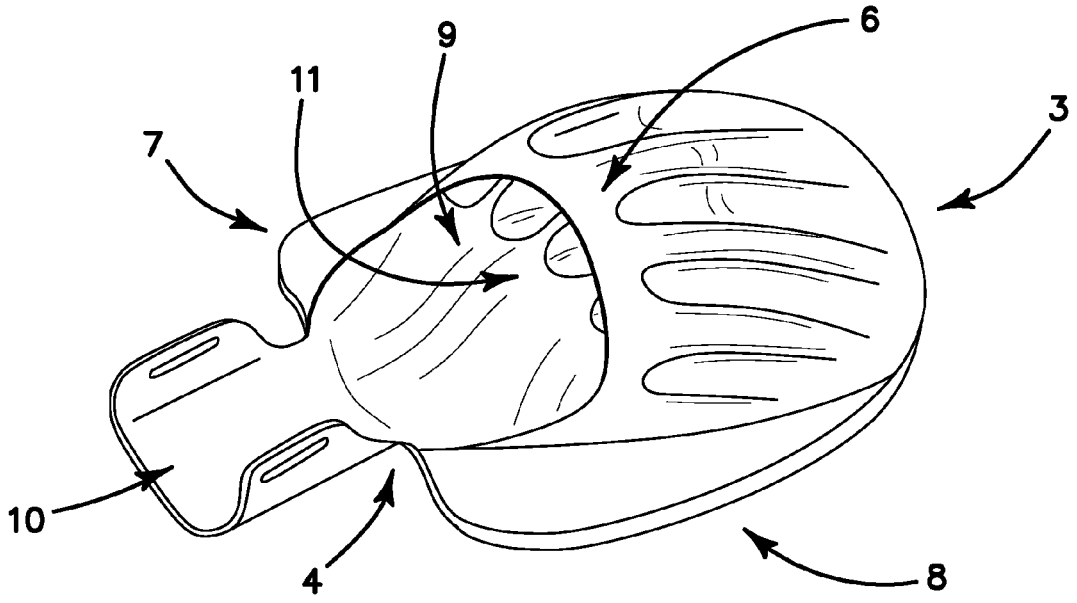
FIG. 3 is a three quarter rear perspective view of the right hand fin of FIG. 1.

As shown in FIG. 3, right hand fin 1 includes a front 3 and rear 4. The front 3 is rounded and the left 7 and right 8 edges are symmetrical to one another. As shown in FIG. 7, the front 3 has a tilted up portion 16 and the back 4 has a tilted up portion 17 which creates a curvature on the bottom of the hand fin called a "rocker." Due to the rocker, when the hand fin is being ridden with the front 3 straight forward, the water first hits the fin about a third of the way back from the front 3 to the rear 4. The rocker creates lift and reduces the chance that water flows on top of the front 3, thus pushing the hand fin down and causing the hand fin and user to be pulled downward, into the wave 31 or also known as "pearling." Pearling can occur when water pushes against the top surface 6 at a wrong angle. FIG. 8 shows a close up view of the rounded peripheral lip 13 that encircles fin portion of the hand fin 1. The rounded lip 13 allows water to flow smoothly over the lip and decreases the likelihood that the water will catch an edge on the lip, thus reducing the chances of pearling. The rounded peripheral lip 13 is also angled upward, facilitating passage of the water under the hand fin 1. The angled upward lip reduces pearling in all directions and thus the hand fin 1 can be ridden in many different ways and with many different angles to the wave 31.

Figure 10:
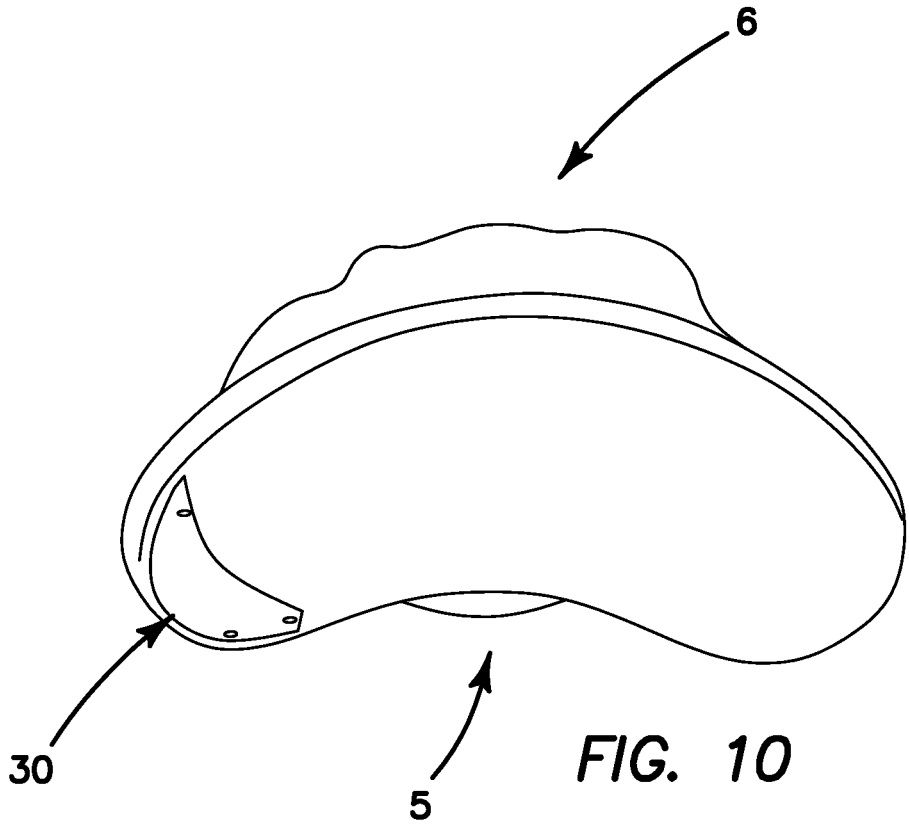
FIG. 10 is a front elevational view of the right hand fin of FIG. 1.

As shown in FIG. 10, the right hand fin 1 includes a bottom 5 and top 6 surface. FIG. 12 shows the bottom of the hand fin and the general shape. The left side 7 and right side 8 are symmetrical. The bottom surface 5 is a smooth surface, which allows the hand fin 1 to travel through the water with little resistance. The bottom surface 5 has a concave portion or concavity 14 from the left edge 7 to the right edge 8, best seen in FIG. 6, and a concave portion or concavity 15 from the front 3 to the back 4, best seen in FIG. 11. In other words, the bottom surface 5 is curved upwardly, away from the surface of the water. The concavities 14, 15 channel the water under the hand fin, increases the speed of the hand fin, and creates lift. Water led into the concavity 14, 15 flows along the upper curvature, which causes the water to push up on the bottom 5 and then down, away from the fin. This creates lift, which pushes the fin and the user 2 above the water. The curvature allows the left 7 and right 8 edges to cut into the wave thus giving the user 2 directional control.

The streamlined nature of the bottom 5 and top 6 makes it possible for the user 2 to ride the wave 31 with the hand fin skimming across the water as well as with the hand fin submerged underwater. The top surface 6 has a downward slope from rear 4 to front 3. It is design so that when water hits it, the water pushes down on the hand fin. Therefore, when it is submerged underwater, the water's upward pressure on the bottom surface 5 and downward pressure on the top surface 6 stabilizes the hand fin. Additionally, the upward pressure is greater than the downward pressure. Therefore, the user can easily bring the hand fin back to the surface of the water by angling the hand fin up towards the surface of the water.

Figure 4:
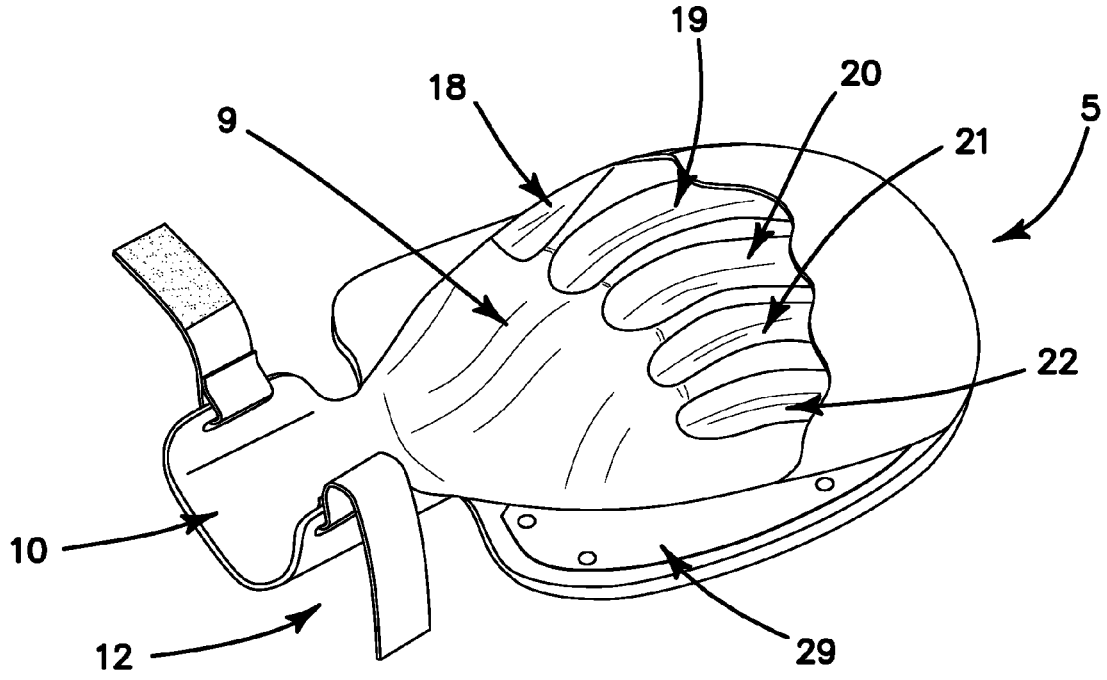
FIG. 4 is a three quarter rear perspective view of the hand fin with the top surface partially removed.
Figure 5:
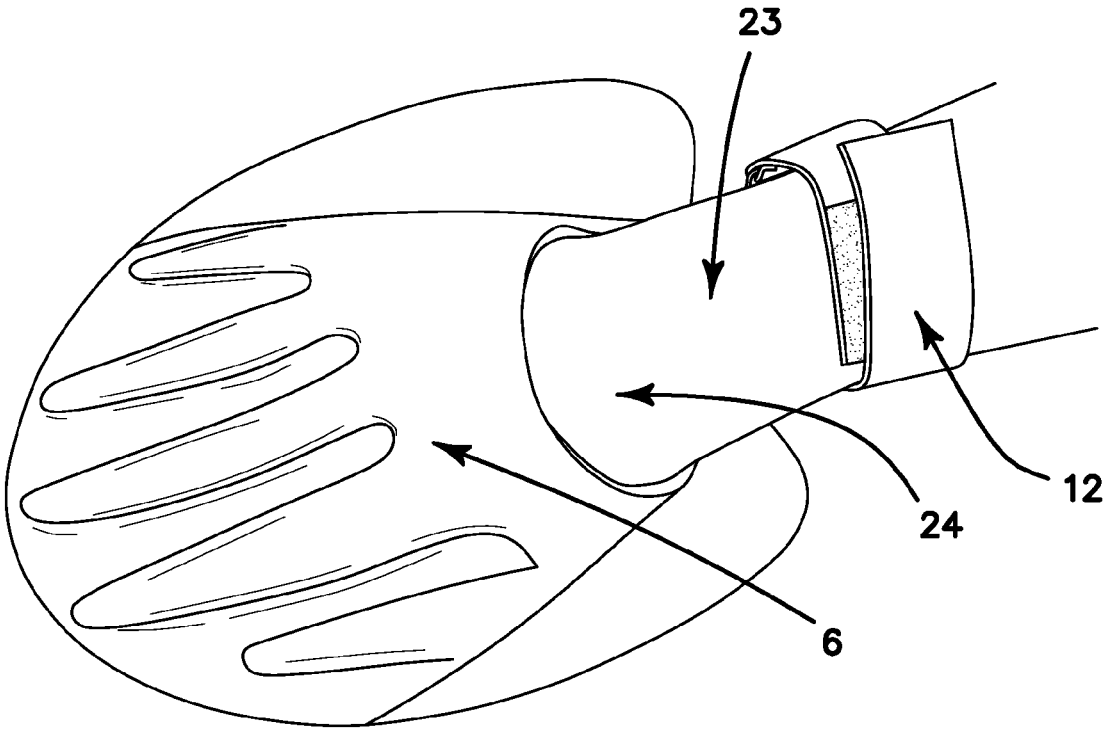
FIG. 5 is a top perspective view of the right hand shown in the right hand fin.
Figure 11:
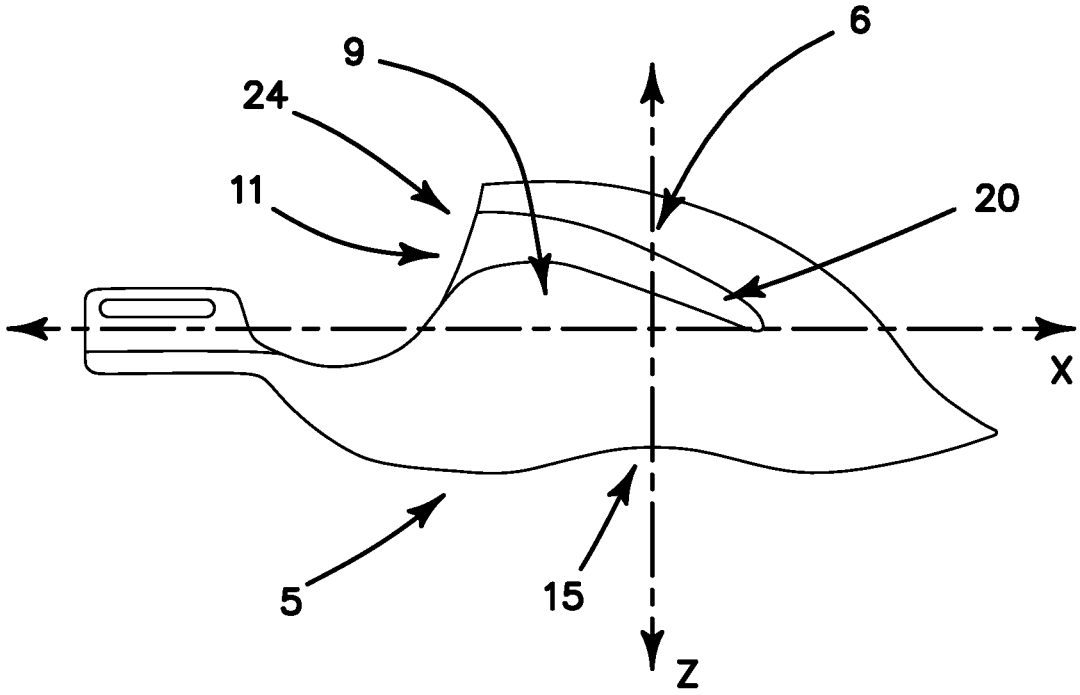
FIG. 11 is a longitudinal cross sectional view of the hand fin.
Figure 12:
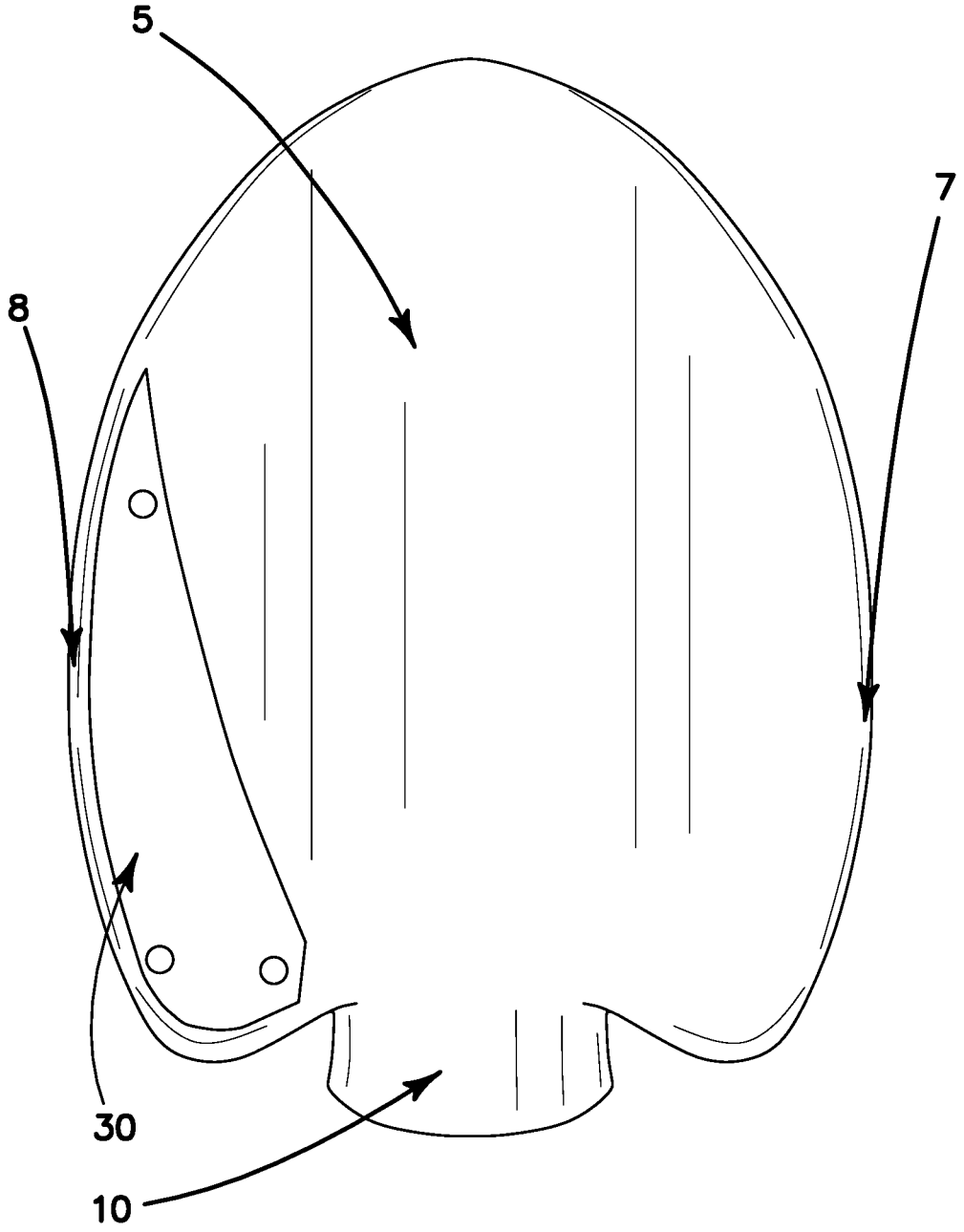
FIG. 12 is a bottom perspective view of hand fin.

As shown in FIG. 4, FIG. 5, and FIG. 11 an internal compartment 11 is defined in the hand fin 1 between the top 6 and bottom 5 surfaces. The bottom surface 5 has a raised section 9 that extends into the internal compartment 11. This raised section 9 has a gradual downward slope from the middle of the raised section 9 outward toward the edges of the hand fin 1. The raised section 9 is designed to ergonomically conform to the palm portion of the hand 23. The bottom surface 5 also contains a plurality of finger compartments 18, 19, 20, 21, 22 for the placement of each finger of the hand 23 in the corresponding one of the plurality of finger compartments 18, 19, 20, 21, 22. The finger compartments 18, 19, 20, 21, 22 conform to each finger of the hand 23. The downward slope of the raised section 9 causes the hand 23 to be configured in a relaxed, cupped configuration. FIG. 5 shows the outline of the hand 23 in the hand fin 1. The fingers are slightly curved and each individual finger compartment 18, 19, 20, 21, 22 is spread apart from the finger compartment 18, 19, 20, 21, 22 next to it. Therefore, when the user inserted his hand 23, his fingers are spread apart in a comfortable manner. FIG. 11 shows a cross section along the X-axis (front to back) of the hand fin 1 and the gradual slope of the raised section 9. As shown in FIG. 7, the raised section 9 places the area for the knuckles of the hand 23 over the center of gravity 26 of the hand fin 1. The finger compartments 18, 19, 20, 21, 22 are forward of the center of gravity 26. FIG. 6 and FIG. 7 show the hand fin 1 on an X-axis, a Y-axis, and a Z-axis. X=0 is half way between the front 3 and back 4 of the fin. Y=0 is half way between the left 7 and right 8 edges. Z=0 is half way between the bottom and the top. (0,0,0) is the center point of the hand fin. In this embodiment, the center of gravity 26 of the illustrated embodiment is located at Y=0 mm, X=−20.5 mm, and Z=43.3 mm. The area for the knuckles is parallel with the Y-axis. The hand placement allows for better leverage and control during swimming. It also decreases the inadvertent bouncing of the hand fin 1 while riding the wave 31 compared to hand placement that is further back on the hand fin 1. FIG. 4 shows the hand fin 1 with the top surface 6 removed. The hand compartment is indented into the surrounding material.

The top surface 6 defines the top of the internal compartment 11. The finger compartments 18, 19, 20, 21, 22 and the compartment 11 whose bottom surface is defined by the raised section 9 are one integral compartment with a single common access opening 24 located about ¾ rearward on the hand fin 1. The top surface 6 extends about halfway between the knuckles of the hand 23 and the wrist. The internal compartment 11 is sized so that the hand 23 fits securely within the compartment 11. Water is obstructed from entering the internal compartment 11 while the hand 23 is in place. For added grip and control of the hand fin 1, the user 2 can grip down into the material, thus creating pressure between the bottom of the fingers and the bottom surface 5 and pressure between the top of the knuckles and the top surface 6. Essentially, the hand 23 creates a wedge within the internal compartment 11, ensuring that the user maintains control of the hand fin 1. Preferably, the hand fin 1 is formed from one piece of flexible material to provide an integral hand fin 1. The preferred flexible material is closed cell form made from ethylene vinyl acetate. This flexible material increases the amount of pressure between the hand 23 and the fin 1 because the hand 23 can be bent at a more dramatic degree, thus increasing grip and control. The flexible material also accommodates various hand sizes as the material can give for larger hands. As shown in FIG. 11, the preferred embodiment of the internal compartment 11 has textured internal walls for frication engagement with the hand 23.

Figure 9:
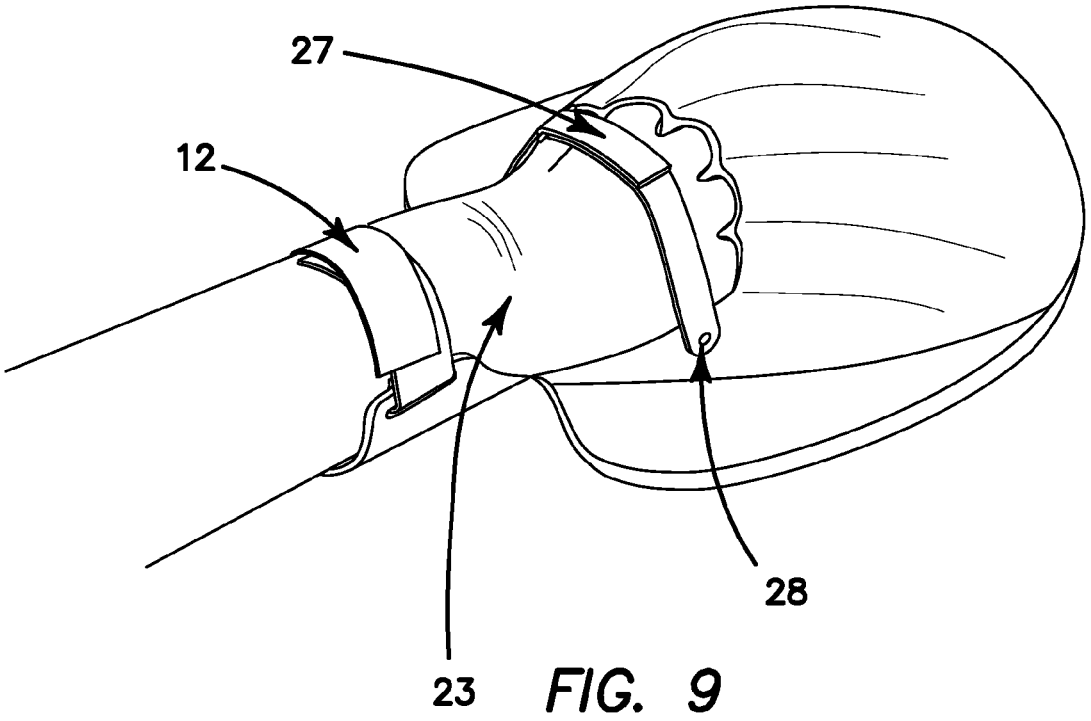
FIG. 9 is a three quarter perspective view of the hand fin with an adjustable knuckle strap.

An alternative version is shown in FIG. 9, where the top surface 6 extends only over the finger compartments 18, 19, 20, 21, 22, preferably leaving, if the hand 23 was inserted into the internal compartment 11, the knuckles and the portion of the fingers from the knuckles to the first joints, exposed. An adjustable, removable strap 27 is added to the hand fin 1 where if the hand 23 was in the internal compartment 11, the strap 27 would be placed over the knuckles. The strap 27 creates the same tension and pressure between the hand 23 and the hand fin 1 as mention above, but in this version, the knuckles press against the strap 27 instead of the top surface 6. The strap 27 is partially made of Velcro and is adjustable. Therefore, it can accommodate different sized hands 23. The strap 27 will be adjustable by the loosening or tightening of a Velcro portion of the strap 27. The portion of the strap 27 that falls over the knuckles is made from the same material as the hand fin 1, making it flexible and comfortable. The strap 27 is detachable where the rivet 28 is located. An identical rivet (not shown) is located on the opposite side of the hand fin 1.

As shown in FIG. 4 and FIG. 10, pieces of material 29, 30 can be added to the peripheral regions of the top surface and/or the bottom surface. The pieces of material 29, 30 can be parallel to each other and can be attached to the fin 1 in a variety of ways, for example they can be glued to the fin 1 or screwed in to the fin 1. The pieces of material 29, 30 preferably conform to the shape of the fin's edges and are made from a plastic. The pieces of material 29, 30 are meant to strengthen the edges of the hand fin 1. In the prefer embodiment, the attachable pieces of material 29 are placed on the top surface 6 on the left and right sides of the hand fin.

Additionally, as shown FIG. 4, the hand fin 1 has an integral wrist strap connector 10 for the attachment of a leash 12. The wrist strap connector 10 lies flat against the wrist when the hand 23 is inserted into the internal compartment 11. The wrist strap connector 10 is ergonomically designed to give support to the wrist. The wrist strap connector 10 is hydrodynamically designed to decrease drag. When water flows from the front 3 to the back 4 or from back 4 to front 3, the water can freely and smoothly flow over the wrist strap connector 10. The wrist strap connector 10 also prevents water from entering the internal compartment 11. If the user is maneuvering in such a way that water is flowing from back 4 to front 3, the wrist strap connector 10 directs water flow to underneath the hand fin 1 and prevents water from freely entering the internal compartment 11. The leash 12 is detachable from the hand fin 1. When the hand fin 1 is being used, the user should wrap the leash 12 securely around the wrist. The leash 12 allows the user 2 to remove the hand fin without the worry of the hand fin floating away. It also ensures the hand fin is not lost if the hand fin is unexpectedly pulled away from the hand.

The hand fin 1 can be used for bodysurfing, swimming, and general use in water. The broad bottom surface 5 creates greater water resistance then a user can create with the user's own hand.

Although the invention has been illustrated and described as a bodysurfing and swimming aid, the invention is not limited to the uses in the details above. Various modifications and versions may be made without divergence from the general spirit of the invention. For example, users may use the hand fins to ride on snow with their hands. Other users may use the hand fins during sports such as handball where the hand fins are used much like a paddle or racquet.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

What is claimed is:

1. A hand fin for use on a hand of a user in water comprising a buoyant blade having a front and rear, bottom and top surfaces, and left and right edges, the bottom surface being concave between the front and rear and concave between the left and right edges, where the blade includes a peripheral lip encircling the blade, and a rocker formed by the blade extending from front to rear where the front of the blade has a tilted up portion and the rear of the blade has a tilted up portion which create a curvature on the bottom of the blade creating lift and reducing the chance that water flows on top of the front of the blade; and an internal compartment defined in the blade between the top and bottom surfaces and aligned therewith having a plurality of finger compartments, an opening defined in the top surface toward the rear of the blade, where the hand of the user is inserted through the opening into the plurality of finger compartments of the internal compartment, where the top surface extends only over the finger compartments such that when the hand is inserted into the internal compartment the knuckles and the portion of the fingers from the knuckles to first joints of the hand are exposed;

where the plurality of finger compartments is further defined by the blade having a raised section extending into the internal compartment having defined in the blade the plurality of finger compartments for the placement of each finger of the hand into a corresponding one of the plurality of finger compartments and the blade having a shape conforming to each finger of the hand to create a gripping surface in which the hand can be placed in a cupped configuration.

2. The hand fin of claim 1 and further comprising another hand fin attachable on the other hand of the user, where the hand fins have mirror symmetry to each other.

3. The hand fin of claim 1 wherein the blade and internal compartment defined in the blade are simultaneously formed to provide an integral hand fin.

4. The hand fin of claim 1 wherein the front is rounded and the left and right edges are symmetrical.

5. The hand fin of claim 1 wherein the blade is made of a flexible material.

6. The hand fin of claim 1 wherein the flexible material is closed cell foam made from ethylene vinyl acetate.

7. The hand fin of claim 1 wherein the raised section and finger slot compartments are ergonomically designed.

8. The hand fin of claim 1 wherein the peripheral lip is rounded.

9. The hand fin of claim 1 wherein the peripheral lip is angled upwardly toward the top surface thus facilitating passage of water under the hand fin.

10. The hand fin of claim 1 wherein the top surface slopes downwardly from the rear to the front.

11. The hand fin of claim 1 further comprising an integral, ergonomically designed wrist strap connector that conforms to a wrist and extends from the bottom surface for attachment of a leash.

12. The hand fin of claim 1 wherein the internal compartment has an internal wall which is textured for frictional engagement with the hand.

13. The hand fin of claim 1 wherein the blade has a center of gravity, and where the internal compartment is defined within the blade so that the plurality of finger compartments are forward of the center of gravity.

14. The hand fin of claim 1 further comprising an attachable piece of material on the surface of the blade to strengthen the edges of the blade.

15. The hand fin of claim 1 where the bottom surface of the blade has a concave surface between the right and left edges and a concave surface between the front and the back.

16. A bodysurfing arrangement for use in water by bodysurfers, comprising the hand fin of claim 1 on one hand where that hand is placed in front of the body and the other hand is placed at the leg or on top of the blade.

17. A bodysurfing arrangement for use in water by bodysurfers of claim 15, comprising a pair of hand fins, one hand fin for the left hand and one hand fin for the right hand.

18. A method for using two hand fins, where each hand fin for use on a hand of a user in water comprising a buoyant blade having a front and rear, bottom and top surfaces, and left and right edges, the bottom surface being concave between the front and rear and concave between the left and right edges, where the blade includes a peripheral lip encircling the blade, and a rocker formed by the blade extending from front to rear where the front of the blade has a tilted up portion and the rear of the blade has a tilted up portion which create a curvature on the bottom of the blade creating lift and reducing the chance that water flows on top of the front of the blade; and an internal compartment defined in the blade between the top and bottom surfaces and aligned therewith having a plurality of finger compartments, an opening defined in the top surface toward the rear of the blade, where the hand of the user is inserted through the opening into the plurality of finger compartments of the internal compartment, where the top surface extends only over the finger compartments such that when the hand is inserted into the internal compartment the knuckles and the portion of the fingers from the knuckles to first joints of the hand are exposed and where the plurality of finger compartments is further defined by the blade having a raised section extending into the internal compartment having defined in the blade the plurality of finger compartments for the placement of each finger of the hand into a corresponding one of the plurality of finger compartments and the blade having a shape conforming to each finger of the hand to create a gripping surface in which the hand can be placed in cupped configuration, comprising steps selected from the group consisting of:

placing one hand fin on the leg in that the concave bottom conforms with the leg to reduce water friction, and placing the other hand fin out in front of the body, placing one hand fin on the leg in that the concave bottom faces out away from the leg to increase control, and placing the other hand fin out in front of the body, or placing both hand fins in front of the body.

19. A hand fin for use on a hand of a user in water comprising a buoyant blade having a front and rear, bottom and top surfaces, and left and right edges, the bottom surface being concave between the front and rear and concave between the left and right edges, where the blade includes a peripheral lip encircling the blade, and a rocker formed by the blade extending from front to rear where the front of the blade has a tilted up portion and the rear of the blade has a tilted up portion which create a curvature on the bottom of the blade creating lift and reducing the chance that water flows on top of the front of the blade;

an internal compartment defined in the blade between the top and bottom surfaces and aligned therewith having a plurality of finger compartments, an opening defined in the top surface toward the rear of the blade, where the hand of the user is inserted through the opening into the plurality of finger compartments of the internal compartment, where the top surface extends only over the finger compartments such that when the hand is inserted into the internal compartment the knuckles and the portion of the fingers from the knuckles to first joints of the hand are exposed;

where the plurality of finger compartments is further defined by the blade having a raised section extending into the internal compartment having defined in the blade the plurality of finger compartments for the placement of each finger of the hand into a corresponding one of the plurality of finger compartments and the blade having a shape conforming to each finger of the hand to create a gripping surface in which the hand can be placed in a cupped configuration; and an adjustable strap aligned with respect to the knuckles to hold hand in place, the adjustable strap being secured to the fin on each side of the hand.

* * * * *